United States Patent [19]

Fukatsu et al.

[11] Patent Number: 4,787,443

[45] Date of Patent: Nov. 29, 1988

[54] CERAMIC HEAT EXCHANGER ELEMENT

[75] Inventors: Yukio Fukatsu, Tokyo; Yasuhiko Endo; Tetsuo Takehara, both of Yokohama, all of Japan

[73] Assignee: Asahi Glass Company, Ltd., Tokyo, Japan

[21] Appl. No.: 47,546

[22] Filed: May 5, 1987

Related U.S. Application Data

[63] Continuation of Ser. No. 780,600, Sep. 26, 1985, abandoned.

[30] Foreign Application Priority Data

Sep. 28, 1984 [JP] Japan ..... 59-203089

[51] Int. Cl.[4] ..... F28D 7/02

[52] U.S. Cl. ..... 165/165; 165/181; 165/905; 165/907

[58] Field of Search ..... 165/165, 181, 905, 907

[56] References Cited

U.S. PATENT DOCUMENTS

| | | | |
|---|---|---|---|
| 2,615,308 | 10/1952 | Thorns | 165/907 X |
| 2,916,307 | 12/1959 | Peters | 285/299 X |
| 3,121,559 | 2/1964 | Tippmann | 165/83 |
| 3,217,798 | 11/1965 | Renzi | 165/907 X |
| 3,309,072 | 3/1967 | Cummings | 165/81 |
| 3,407,870 | 10/1968 | Braune et al. | 165/83 |
| 4,017,347 | 4/1977 | Cleveland | 156/89 |
| 4,041,591 | 8/1977 | Noll et al. | 165/165 X |
| 4,130,160 | 12/1978 | Dziedzic et al. | 165/166 |
| 4,332,295 | 6/1982 | Lahaye et al. | 165/905 X |
| 4,526,635 | 7/1985 | Heinrich et al. | 165/165 X |
| 4,540,184 | 9/1985 | Takahashi et al. | 165/47 X |
| 4,584,003 | 4/1986 | Oda | 55/269 |
| 4,623,017 | 11/1986 | Oda et al. | 165/82 |

FOREIGN PATENT DOCUMENTS

| | | | |
|---|---|---|---|
| 1129975 | 5/1962 | Fed. Rep. of Germany | 165/907 |
| 582913 | 12/1924 | France . | |
| 726593 | 5/1932 | France . | |
| 2357853 | 3/1978 | France . | |
| 2414988 | 8/1979 | France . | |
| 56-98518 | 8/1981 | Japan . | |
| 56-124417 | 9/1981 | Japan . | |
| 457000 | 11/1936 | United Kingdom . | |
| 577293 | 5/1946 | United Kingdom . | |

OTHER PUBLICATIONS

Patents Abstracts of Japan, vol. 7, No. 31 (M-192) [1176], Feb. 8, 1983.

*Primary Examiner*—Ira S. Lazarus
*Assistant Examiner*—Richard R. Cole
*Attorney, Agent, or Firm*—Oblon, Fisher, Spivak, McClelland & Maier

[57] ABSTRACT

A ceramic heat exchanger element comprises a ceramic honeycomb body, fluid passages formed in the ceramic honeycomb body and ceramic tubes extending through and fixed to the ceramic honeycomb body so as to intersect the fluid passages. The ceramic of the honeycomb body, the fluid passages therein, and the tubes extending through and fixed thereto preferably have a thermal conductivity of 15 Kcal/m/hr/°C. or higher.

13 Claims, 6 Drawing Sheets

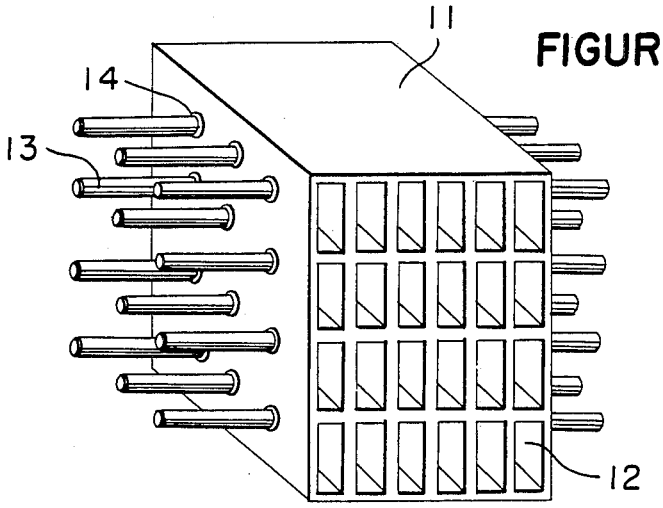
FIGURE 1
FIGURE 2
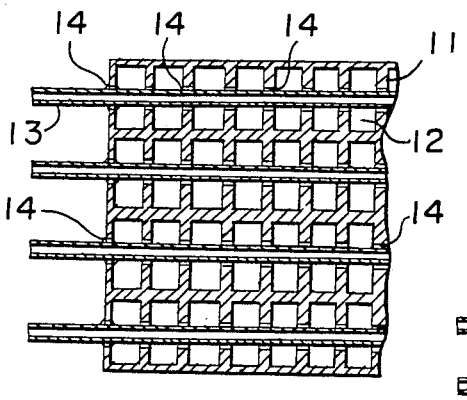
FIGURE 3
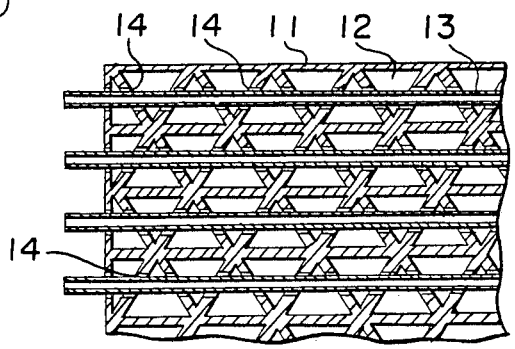

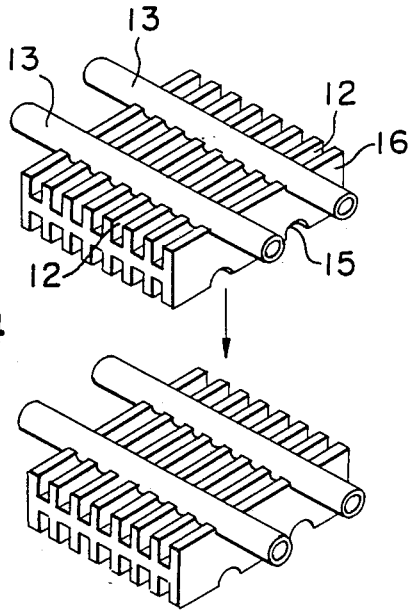
FIGURE 4
FIGURE 5
Prior Art
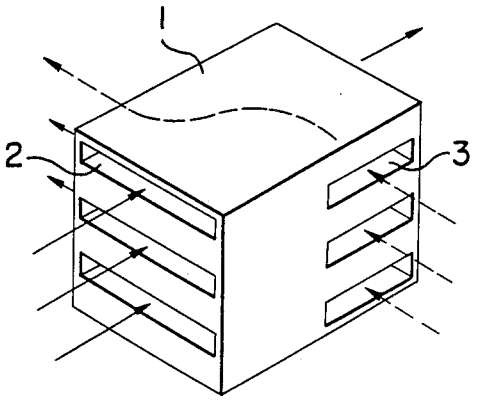

CERAMIC HEAT EXCHANGER ELEMENT

This application is a continuation of application Ser. No. 780,600, filed on Sept. 26, 1985, now abandoned.

The present invention relates to a heat exchanger element made of ceramics which is suitable to recover heat energy from, for instance, a waste gas discharged from diesel engines, boilers and so on.

It has been well known that effective heat exchange is obtainable by providing fins on the outer surface of tubes in a case that fluid such as water is passed in the tubes of a heat exchanger and gas is passed outside of the tubes. For more effective heat exchanging, it has been widely practiced that metallic fins are formed around a metallic tube to form a fin tube.

There have, however, been disadvantages that when a hot gas having a temperature higher than 800° C. is passed outside of a tube, a fin made of an ordinary metallic material is poor in high-temperature resistance. A fin of a special alloy having high-temperature resistant properties is expensive, and has poor thermal conductivity. Further, when a waste gas discharged from, for instance, a diesel engine is used as fluid to be flown outside of the tube, soot firing takes place intermittently and locally owing to carbon particles contained in the waste gas. Since the soot firing produces a region having a high temperature exceeding a melting point of a metallic fin, it has been difficult to use the metallic fin.

When a combustion gas resulted from fuel containing sulphur component as impurities is passed outside of the tube, there arises a problem of corrosion at a low temperature of the outer surface of the fin and the tube, whereby life time of a heat exchanger having fin tubes made of the ordinary metal is considerably reduced.

The following proposals may be provided to overcome the above-mentioned disadvantages. Namely, a ceramic tube is prepared separate from a ceramic fin and they are bonded together, or a ceramic fin tube is prepared by slip casting, injection molding or hydro-isostatic pressing. However, these methods have not been practically used by the reason that technique for bonding a fin having a small thermal resistance has not yet been established and technique of homogeneous molding and for reducing thermal stress has not been economically obtainable.

On the other hand, a heat exchanger element using a ceramic honeycomb is well-known from publications such as Japanese Unexamined Utility Model Publication No. 93695/1981 and Japanese Unexamined Patent Publication No. 31792/1982.

FIG. 5 shows an example of the conventional heat exchanger element in which a main body 1 is in a shape of generally rectangular prism; a plurality of flow-passages 2 for a first fluid are formed vertically and in parallel so as to penetrate a pair of opposing side walls of the main body 1; a plurality of flow passages 3 for a second fluid are formed vertically in the main body so that they penetrate another pair of opposing side walls, and the flow-passages 2 and 3 are arranged alternately with thin partition walls between them. No problem arises in the heat exchanger element 1 when a waste gas and air are passed in the flow passages for heat exchanging in which values of specific heat and heat transfer coefficient of two kinds of fluid at both sides of the partition walls are substantially same. However, when a gas and water are passed for heat exchanging in which values of heat transfer coefficient of the two kinds of fluid at both sides of the partition walla are remarkably different, a heating surface at the gas side is too small while a heating surface at the water side is too abundant, whereby balance of heat transfer is lost and heat transfer efficiency is decreased.

It is an object of the present invention to provide a ceramic heat exchanger element applicable to recovery of heat from, for instance, a hot or corrosive waste gas, having high efficiency of heat exchange and suitable for heat exchanging between different kind of fluids such as a gas and liquid which have fairly different values of specific heat or heat transfer coefficient at both sides of partition walls.

The present invention is to provide ceramic heat exchanger element which comprises a ceramic honeycomb body, fluid passages formed in the ceramic honeycomb body and at least one ceramic tube extending through and fixed to the ceramic honeycomb body so as to intersect the fluid passages.

In the present invention, a honeycomb body refers to an assembly consisting of a large number of mutually parallel passages defined by thin partition walls and having small cross-sectional areas.

In the present invention, it is possible to provide good balance of heat transfer and high efficiency for exchanging heat by making a heating surface for fluid having low heat transfer coefficient and low density greater than a heating surface for fluid having high heat transfer coefficient and high density. In more detail, these results are obtainable by supplying fluid having high density such as water in at least one tube and by supplying fluid having low density such as a waste gas in fluid passages formed in a honeycomb body. In this case, the heating surface may be adjusted by suitably selecting the dimension and shape of the honeycomb body and the number, the wall thickness and the outer diameter of tubes depending on fluid to be used.

In the heat exchanger element according to the present invention, more effective result is obtained when the heat transfer coefficient of fluid to be passed through the tubes is 5 times as large as that of fluid passed through the fluid passages of the honeycomb body. In this case, it is desirable from the viewpoint of balance of heat transfer that the total surface area of partition walls of the fluid passages for the fluid having low density formed in the honeycomb body is 5 times or more as large as the inner surface area of the tubes for the fluid having high density (the total surface area of the partition walls includes the front and rear surfaces of the partition walls when the fluid having low density is in contact with the both surfaces of the walls).

Further, when the fluid having high density is water and the fluid having low density is a waste gas produced by combustion, it is preferable that a heating surface at the gas side (the total surface area of the partition walls of the gas passages) is 10 times or more, especially 20 times or more as large as the heating surface at the water side (the inner surface area in the tubes). In this case, the partition walls of the fluid passages formed in the honeycomb body to which the tube intersects are arranged closely to have a pitch of 10 mm or smaller, preferably about 5 mm or smaller.

In the conventional ceramic heat exchanger element, the partition walls of the fluid passages of the honeycomb body is used as partition walls for separating two kinds of fluids. On the other hand, in the present invention, the partition wall of the fluid passages are not required to have such function and are used as fins for exchanging heat. Thus, since the honeycomb body is used to have function of a fin, an ideal fin that a surface area per volume is large and the total weight is small can be obtained.

Further, the conventional ceramic heat exchanger element is disadvantageous in that when heat exchange between fluids such as a hot gas and air is carried out, the ceramic body is heated to a temperature near the average temperature between the hot gas and air, whereby there arises a large temperature difference at gas inlet and outlet portions in the ceramic body. As a results crack are easily formed in the ceramic body due to thermal stress produced by the temperature difference. In the heat exchanger element of the present invention, however, the honeycomb body and the tube are preferably made of ceramics having high thermal conductivity. Accordingly, it is posssible to control that the temperatures of the tube and the honeycomb body have values close to the temperature of liquid such as water because the partition walls of the fluid passages of the ceramic honeycomb body having high thermal conductivity are used as fins when liquid such as water having very high heat transfer coefficient is passed in the tube. Accordingly, temperature difference at the gas inlet and outlet portions of the ceramic body is small as well as the thermal stress.

As ceramics having high thermal conductivity, it is preferable to use ceramics including as a main component at least one selected from a group consisting of silicon carbide, silicon nitride, aluminum nitride, Si-Al-O-N and silicon. Among such ceramics, it is mostly preferable to use ceramics including silicon carbide as a main component or ceramics of a mixture of silicon carbide and silicon as a main component. However, use of ceramics constituting the honeycomb body and the tube is not limited to the above-mentioned material. In some cases, oxide type ceramics having high thermal conductivity such as alumina, magnesia and so on may be employed.

It is desirable for ceramics for the honeycomb body or the tube to have a thermal conductivity of 15 Kcal/m/hr/°C. or higher, especially, 50 Kcal/m/hr/°C. or higher.

The items as above-mentioned are applicable to a binder. Effective result can be obtained even when a binder is made of a material containing silicon as a main component.

Further, in the present invention, passages for fluid having high density such as water are formed by a relatively small number of tubes. Accordingly, by selecting method of preparation of the tube, the wall thickness of the tube, or treatment of the inner surface of the tube, contamination between two kinds of fluid may be remarkably reduced in comparison with the conventional ceramic heat exchanger element.

Since the honeycomb body and the tube are mutually fixed, the tube neither drops from the honeycomb body nor changes the relative position to the honeycomb body. Preferably, the tube is certainly bonded by applying a binder to areas where both members are in contact with together, although it can be secured by a frictional force without application of special binder at the contacting areas.

In the present invention, a binder is preferably applied at areas where the outer surfaces of the honeycomb body and the tube are in contact so as to provide substantially gas-tight condition. In this case, the binder functions as a sealant for fluid as well as a fixing member for the tube. Further, the binder may be applied at contacting areas between the partition walls in the honeycomb body and the tube to provide excellent heat transfer properties between the honeycomb body and the tube. Gas-tightness between the partition walls in the honeycomb body and the tube is not always required when the binder is applied to the contacting area, but only function of heat transfer between the partition walls acting as fins and the tube is required. For this purpose, it is preferable that an area of at least 30% of the total surface area in the contacting areas between the partition walls and the tube is occupied for bonding by the binder.

In the present invention, it is desirable, from the viewpoint of prevention of cracking due to thermal stress which is resulted from difference in thermal expansion coefficient, that the honeycomb body and the tube are made of substantially same kind of ceramics. More preferably, they are made of silicon carbide ceramics or silicon carbide/silicon ceramics. In this case, it is preferable that the binder is made of silicon carbide, silicon or silicon carbide/silicon mixture. Any of above-mentioned siliceous materials may be easily prepared by a reaction sintering facility. The binder of silicon carbide ceramics prevents cracking of the honeycomb body and tubes due to thermal stress, and the binder of metallic silicon provides its easy preparation.

The heat exchanger element according to the present invention may be prepared as follows. Powder or slurry containing carbon and if necessary, silicon carbide is coated on the outer surface of the tubes of silicon carbide ceramics; the tubes are inserted in the honeycomb body of silicon carbide ceramics; metallic silicon is applied at contacting areas between the tubes and the honeycomb body by way of dipping, siphoning, injecting, coating and so on, and thereafter the tubes and honeycomb body are bonded with the binder of silicon carbide ceramics by sintering them in an atmosphere of molten metallic silicon in which carbon is reacted with silicon. The above-mentioned process is known as a reaction sintering method. By employing the above-mentioned method, bonding of the tubes to the partition walls in the honeycomb body can be carried out easily. It is possible to use reaction-sintered silicon carbide ceramics as a material for the honeycomb body and the tubes as well as the binder. Further, the honeycomb body and the tubes may be subjected to the reaction sintering at the same time of sintering of the binder. In this case, it is difficult to produce thermal stress since thermal expansion coefficient of the honeycomb body, the tubes and the binder is the same. Further, excellent efficiency of heat exchange is obtained because silicon carbide has a high thermal conductivity. The binder may be of metallic silicon. In this case, an example of fabrication of the heat exchanger element is as follows. The tubes of silicon carbide ceramics are inserted in the honeycomb body of the same ceramics; a part or the entirety of the assembly is dipped in a metallic silicon bath to fill metallic silicon in gaps between the honeycomb body and the tubes by capillary action; and thereafter, the assembly is pulled up to cool it, whereby the honeycomb boy and the tubes are firmly bonded. Thus, the heat exchanger element can be easily fabricated and can be satisfactorily used at a temperature not so high.

In the present invention, the tube is arranged at positions so as not to clog the fluid passages in the honeycomb body. Namely, when the tube clogs the fluid passages in the honeycomb body, fluid-flow in the clogged passages is prevented and direct contact of fluid flowing in the honeycomb body to the tube is not attained, thereby reducing heat exchanging efficiency. To avoid such disadvantage, the shape in cross section of the cells of the honeycomb body is made to be elongated rectangle, elongated triangle, elongated hexagonal and so on, and the dimension of the outer configuration of the tube is made to be smaller than the dimension of the shape in cross section of the cells in the elongated direction.

In a preferred embodiment of the present invention, the honeycomb body is formed as a one-piece body by extrusion-molding. By using the extrusion-molding operation, a ceramic heat exchanger element having accurate dimension and shape for each section of the honeycomb body can be easily obtained. A typical embodiment having the construction is shown in FIGS. 1 and 2.

In another preferred embodiment of the present invention, the honeycomb body is formed by stacking a plurality of layered bodies, and the tubes are extended in parallel to the stacking planes of the layered bodies. A typical embodiment having the construction is shown in FIG. 4.

In another preferred embodiment of the present invention, the honeycomb body is formed by stacking a plurality of layered bodies, and the tubes are extended to the stacking planes of the layered bodies so as to intersect at right angles with the planes. A typical embodiment having the construction is shown in FIG. 8.

In the present invention, it is desirable that the honeycomb body is formed by laminating a plurality of corrugated plates or a plurality of corrugated plates and flat plates. In this case, the tube is preferably arranged so as to intersect the planes of lamination although it is possible that the tube is arranged in parallel to the planes of lamination. A typical embodiment having the construction is shown in FIG. 8.

When the heat exchanger element of the present invention is fabricated by using the above-mentioned lamination method, the following steps may be taken. A carbon paper, preferably, a carbon paper combined with resinous material is shaped into a corrugated form; a plurality of corrugated carbon papers are laminated and if necessary, bonded to have a predetermined shape of honeycomb; thus obtained honeycomb body is subjected to cutting operations in which the corrugated plates are pierced to form tube inserting portions; tubes made of carbon paper, especially, carbon paper combined with resinous material are inserted in the tube inserting portions; a part of the honeycomb body is dipped in a molten metallic silicon bath so that the metallic silicon is impregnated with the entirety of the honeycomb body due to capirally action, and at the same time the metallic silicon is filled in gaps formed in contacting area between the honeycomb body and the tubes; and a reaction sintering method is applied to the honeycomb body and the tubes. Thus, a heat exchanger element comprising the honeycomb body, the tubes and the binder, all of which are made of silicon carbide ceramics or silicon carbide/silicon ceramics is obtained. Alternately, a step of cutting the tube inserting portions to the corrugated plates may be applied before they are laminated or bonded. Tubes of silicon carbide ceramics which has been previously prepared may be used. A part of resinous material or almost all resinous material may be removed by heating treatment or use of a solvent before treating of the heat exchanger element in the molten metallic silicon bath. In the present invention, it is preferable that the honeycomb body and/or the tubes are made of material comprising carbon or a mixture of carbon and silicon carbide as a main component and silicon impregnated with it. Similarly, it is preferable that the binder is one comprising silicon or a mixture of silicon and silicon carbide as a main component.

In the present invention, use of a plurality of the tubes is desired in practical viewpoint even though a single tube may be used. The plurality of tubes are preferably arranged in parallel with each other. Further, it is desired that a single or a plurality of tubes intersect the gas passages of the honeycomb body at right angles.

A more complete appreciation of the invention and many of the attendant advantages thereof will be readily obtained as the same becomes better understood by reference to the following detailed description when considered in connection with the accompanying drawings, wherein:

FIG. 1 is a perspective view showing an embodiment of the heat exchanger element according to the present invention;

FIG. 2 is a cross-sectional view of the heat exchanger element shown in FIG. 1;

FIG. 3 is a cross-sectional view of another embodiment of the present invention;

FIG. 4 is a perspective view in a disassembled state showing an example of preparation of the heat exchanger element of the present invention;

FIG. 5 is a perspective view of a conventional ceramic heat exchanger element;

Figure 6:
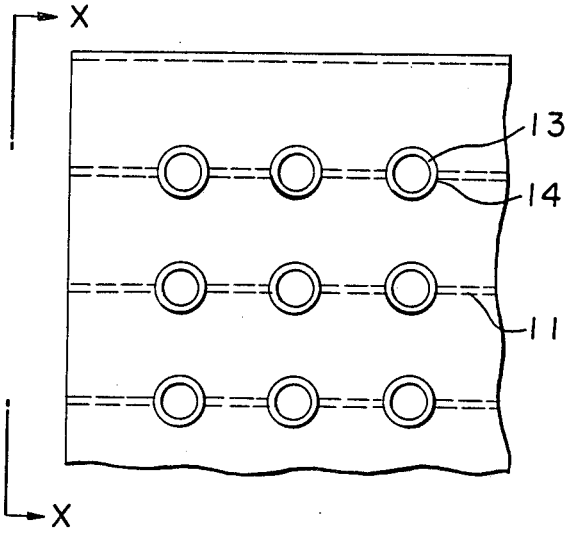
FIG. 6 is a side view showing another embodiment of the present invention.

More detailed description will be made with reference to drawings.

FIGS. 1 and 2 show the first embodiment of the present invention.

A honeycomb body 11 formed by extrusion-molding ceramics comprises a number of cells 12 which are rectangular and extend in parallel with each other. A plurality of through holes are formed in the honeycomb body so as to intersect gas passages formed by the cell 12 at right angles, a plurality of tubes 13 made of the same ceramics are inserted in the through holes. In this case, as shown in FIG. 2, the tubes 13 intersect each longer side in cross-sectional view of the cells 12 at right angles, and they intersect side walls of the cells 12 in the elongated direction at right angles whereby passages formed by the cells 12 are not clogged by the tubes 13.

In this embodiment, the honeycomb body 11 and the tubes 13 are both made of silicon carbide ceramics. Metallic silicon is impregnated under a high temperature condition in gaps formed between the outer diameter of the tubes 13 coated with carbon and the inner diameter portion of the through holes of the honeycomb body 12, followed by reaction sintering to thereby form a binder 14 of silicon carbide ceramics.

The binder 14 is provided not only on the outer wall portion of the honeycomb body 11 but also on the partition walls in the honeycomb body, whereby the tubes 13 are jointed to each partition wall of the honeycomb body 11 by the binder 14. Thermal resistance with respect to structural elements is thus made small to the extent practically negligible. Further, a slurry or a suspension of glaze is introduced in the inner surface of the tubes followed by sintering of the tubes, or plastic material such as fluorine-contained resin is poured or coated on the inner surface of the tubes to impart to the tubes gas-tightness. Thus, leakage of fluid from pin-holes and fine cracks is prevented.

When heat exchange between a waste gas at a high temperature and water is conducted in the heat exchanger element having the above-mentioned construction, the hot waste gas is passed through each cell 12 of the honeycomb body 11 and water is passed through the tubes 13. Then, the waste gas collides the tubes 13 and is deflected by the tubes in the honeycomb body 11, during which the waste gas heats the tubes 13 as well as partition walls in the honeycomb body 11. The tubes 13 are directly heated by the waste gas while they are heated by heat transfer from the partition walls of the honeycomb body 11. Since the partition walls of the honeycomb body 11 are connected to the tube 13 by the binder 14 of silicon carbide ceramics, excellent heat transfer is imparted and the partition walls of the honeycomb body 11 functions as fins for increasing heat transfer properties. The same heat transfer properties can be obtained even by the binder of metallic silicon.

Thus, water, having high wall-suface heat-transmittance, is heated with excellent efficiency even though it is passed through the tubes 13 having a relatively small heating surface, while a hot waste gas having poor wall-surface heat-transmittance effectively transfers heat to the partition walls of the honeycomb body 11 and the tubes 13 during being passed through each cell 12 of the honeycom body 11 having a large heating surface. Accordingly, good balance of heat exchange is maintained between the heating side and the heated side, hence high efficiency of heat transferring is obtainable.

Experiments were conducted using a heat exchanger element prepared by the first embodiment.

The honeycomb body 11 was shaped to have a side of 100 mm in a square outer configuration in cross-section and a depth of 200 mm. Each cell 12 was formed to have a passage in cross-section of 24.7 mm×2.7 mm. The wall thickness defining each cell was 0.3 mm. Thirty-two tubes 13 having an outer diameter of 5 mm were used. Gas was passed in the perpendicular direction with respect to the surface of the drawing representing FIG. 2 at a flow rate of about 400 $Nm^3/h$. Temperature of the gas was about 400° C. at inlet sides and about 280° C. at outlet sides. Water was introduced in the tubes at a flow rate of 1.8 $m^3/h$ in which temperature of water is about 70° C. at inlet sides and about 80° C. at the outlet sides. Heat transfer coefficient at the water side inside of the tubes 13 was about 11400 $Kcal/m^2h°C.$ and heat transfer coefficient at gas side outside of the tubes 13 was about 106 $Kcal/m^2h°C$. However, effective heating surface at the gas side could be 30 times or more of the inner surface of the tubes 13 owing to the partition walls of the honeycomb body 11. As a result, a heat exchange quantity of 17000 Kcal/h could be obtained as a whole.

Relations as above-mentioned can be expressed as follows.

$$\begin{aligned} Q &= Gw(Cpw_2\, Tw_2 - Cpw_1\, Tw_1) \\ &= Gg(Cpg_1\, Tg_1 - Cpg_2\, Tg_2) \\ &= UAg\Delta Tm \end{aligned}$$

Water flow rate: $Gw=1.8\ m^3/hr$
Specific heat of water (at inlet):
$Cpw_1=979\ Kcal/m^3°C.$
(at $Tw_1=70°$ C.)
Specific heat of water (at outlet):
$Cpw_2=975\ Kcal/m^3°C.$
(at $Tw_2=80°$ C.)
Gas flow rate: $Gg=400\ Nm^3/hr$
Specific heat of gas (at inlet):
$Cpg_1=0.343\ Kcal/m^3°C.$
(at $Tg_1=400°$ C.)
Specific heat of gas (at outlet):
$Cpg_2=0.338\ Kcal/m^3°C.$
(at $Tg_2=280°$ C.)
Heating surface at inner side of tube: $Aw=0.0348\ m^2$
Heat transfer coefficient of inner surface of tube:
$\alpha w=NuwKw/Di=11400$
Nusselt number at water side: $Nuw=70.0$
Thermal conductivity of water in tube:
$Kw=0.572\ Kcal/mhr°C.$
Inner diameter of tube: $Di=0.0035\ m$
Heating surface at gas side: $Ag=1.285\ m^2$
Heat transfer coefficient at gas side:
$\alpha g=NugKg/Do=106$
Nusselt nubmer at gas side: $Nug=12.6$
Thermal conductivity of gas:
$Kg=0.042\ Kcal/mhr°C.$
Outer diameter of tube: $Do=0.005\ m$
Overall heat transfer coefficient (U) is expressed by the following equation:

$$1/U=1/\alpha g+\gamma+\gamma f+Ag/Am\times Tt/Kt+1/\alpha w\ (Ag/Aw)$$

Fowling factor: $\gamma=0.002\ m^2hr°C./Kcal$
Heat resistance of fin: $\gamma f=0.0048\ m^2hr°C./Kcal$
Heating surface of tube at average diameter:
$Am=0.040\ m^2$
Wall thickness of tube: $Tt=0.00075\ m$
Thermal conductivity of tube: $Kt=110$ Kcal./mhr°C.
Accordingly, $U=51.0\ Kcal/m^2hr°C.$
Logarithmic mean temperature difference:

$$\Delta Tm = \frac{(Tg_1 - Tw_2) - (Tg_2 - Tw_1)}{\ln[(Tg_1 - Tw_2)/(Tg_2 - Tw_1)]} = 281$$

Thus, a value of about 17000 Kcal/h is obtained in each equation concerning Q. A value of pressure loss is 190 mm $H_2O$ at the side of gas and 110 mm $H_2O$ at the side of hot water, both of which being lower values.

Description will be made as to a case that the heat exchanger element of the present invention is utilized as an apparatus for recovering heat from a waste gas of a diesel engine of a bus. The waste gas is passed through each cell 12 of the honeycomb body 11 and cooling water for cooling the engine is passed through the tubes 13 to heat the cooling water by heat of the waste gas. The cooling water heated is utilized to warm the car cabin by feeding it to a fan heater separately provided. When heat energy of the waste gas is transferred to the cooling water at the start-up of the engine, it helps warming-up of the engine for the purpose of a preheater. Further, various ways of utilization can be considered by heating water in a system independent from the cooling water for the engine. For example, it is possible to provide sevices of a hot water to passangers in the bus.

The fluid passed in the tubes is not always liquid but may be fluid having high density such as highly pressurized air or gas. The heat exchanger element of the present invention is effective in view of balance of heat when the fluid having high density is heated.

FIG. 3 shows another embodiment of the heat exchanger element of the present invention. In this embodiment, the honeycomb body 11 having cells 12 each being triangular in cross section is used. However, the honeycomb body having the cells 12 of another shape in cross section can be used.

Figure 7:
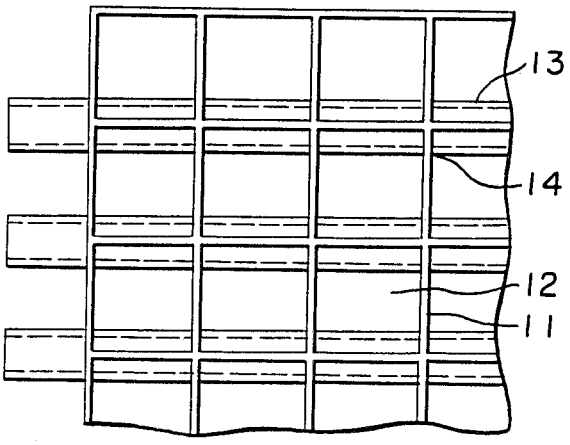
FIG. 7 is a front view taken along a line X—X in FIG. 6.

In the embodiments as above-mentioned, the tube inserting holes are usually formed by drilling incontinuously the partition walls of the honeycomb body 11. In this case, many number of cracks may be produced in the partition walls. However, as shown in FIGS. 6 and 7, occurrence of cracks can be reduced by drilling the honeycomb body 11 so that the center line of each of the tube inserting holes passes through the partition walls which are in parallel to the tubes extended in the honeycomb body 11. This method of drilling allows easy drilling operation in a continuous manner. Electric discharging or laser may be used for perforating the tube inserting holes instead of a drill.

FIG. 4 shows another embodiment for fabricating the heat exchanger element of the present invention. This embodiment is suitable in a case that the thickness of the partition walls of the honeycomb body 11 is too thin to be difficult to perforate the tube inserting holes or it is desirable to form gaps between the splitted honeycomb bodies. In this embodiment, the honeycomb body comprises splitted honeycomb bodies 16 and each of the splitted honeycomb bodies 16 is provided with recesses 15 in a semicircular form which is slightly larger than the outer diameter of the tube 13. The honeycomb body 11 is fabricated by fitting the tubes 13 in the recesses 15 of the splitted honeycomb body 16 and by connecting a plurality of the splitted honeycomb bodies 16.

Figure 8:
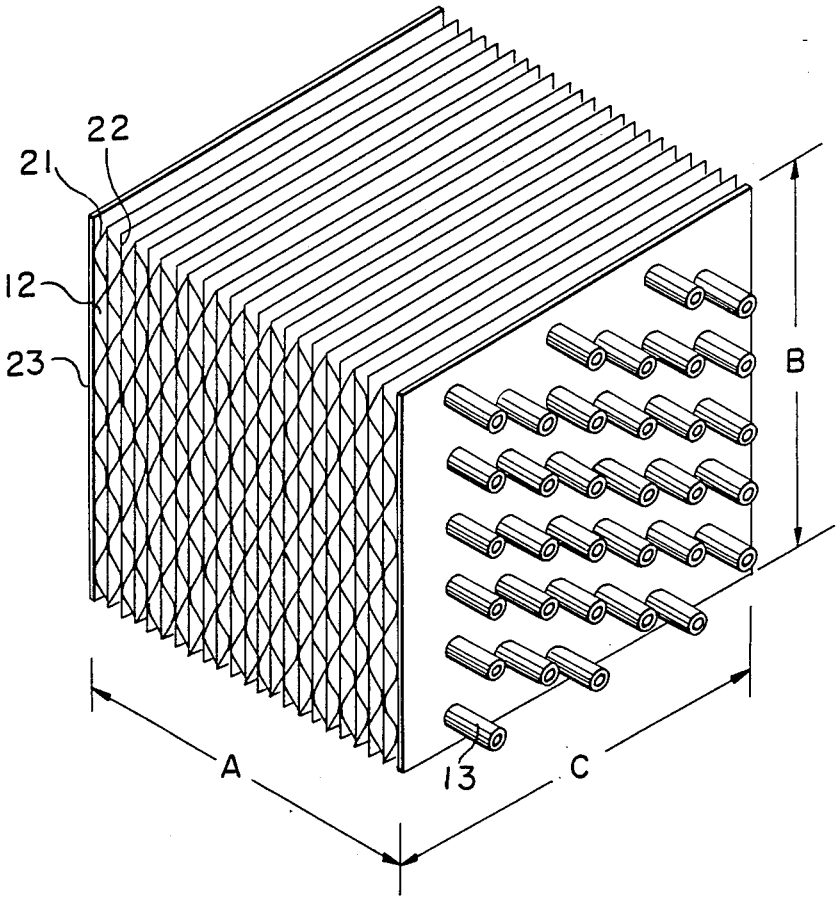
FIG. 8 is a perspective view of still another embodiment of the present invention.

FIG. 8 shows a still another embodiment of the heat exchanger element in which corrugated plates 21 and flat plates 22 are alternately laminated.

Fabrication of the embodiment shown in FIG. 8 is carried out as follows. A number of carbon papers combined with resinous material are prepared. The carbon papers are formed into corrugated plates each having sinusoidal wave and flat plates 22. Punching operations are carried out to the corrugated plates and the flat plates at positions where the tubes 13 are inserted. A predetermined number of the corrugated plates 21 and flat plates are alternately laminated. At both end parts, a pair of end plates 23 prepared by the same material as the corrugated or flat plates and having a thickness greater than the flat plates 22 are attached to assure accuracy in dimension of the element and to protect the heat exchanger element from damage. A predetermined number of tubes 13 of silicon carbide, ceramics and formed by extrusion-molding are inserted in the tube inserting holes. The heat exchanger element has a construction such that two corrugated plates 21 are arranged with a flat plate 21 interposed therebetween so that ridge portions in the two corrugated plates 21 are adjacent to each other and each of the tubes 13 is positioned on the line connecting the top of the ridge portions of the corrugated plates 21. In this case, each cell 12 in a generally semicircular form which is defined by a corrugated plate 21 and a flat plate 22 functions as a fluid passage. Location and outer diameter of the tubes 13 are suitably selected so as not to clog each cell.

Thus obtained assembly of the heat exchanger element is treated in a molten metallic silicon bath as described before after the resinous material is removed from the assembly, whereby much amount of carbon component in the corrugated plates 21, the flat plates 22 and the end plates 23 is changed to silicon carbide by reaction sintering, and fine pores formed in the sintered silicon carbide are substantially filled with silicon. Fine pores formed in the sintered silicon carbide in the tubes 13 is almost filled with silicon. Further, gaps formed in the contacting areas among the corrugated plates 21, the flat plates 22 the end plates 23 and the tubes 13 are almost filled with silicon and a part of the silicon is changed to silicon carbide to become a strong binder.

Dimensions of the heat exchanger element obtained as above-mentioned are as follows.

Figure 9:
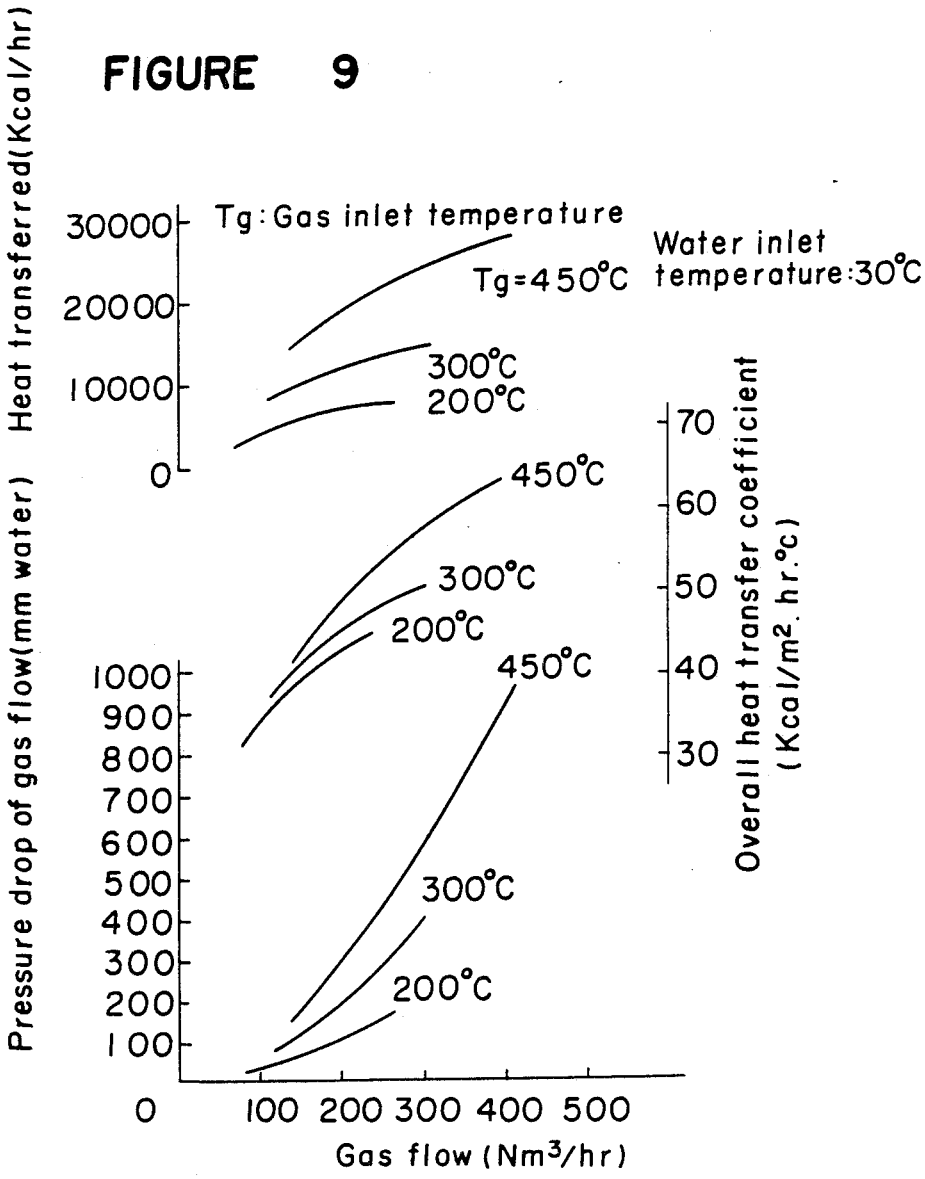
FIG. 9 represents performance curves of the heat exchanger element shown in FIG. 8.

Width (A): 125 mm
Height (B): 132 mm
Depth (C): 160 mm
Number of corrugated plates: 23
Number of flat plates (including a pair of end plates 23): 24
Distance between adjacent ridge portions in a corrugated plate 21: 22 mm
Distance between adjacent ridge portion and bottom portion in corrugated plate 21: 4.9 mm
Number of tubes 13: 33
Outer diameter of tubes: 7 mm
Effective heating surface: 1.4 $m^2$ Experiments were conducted to test performance of the heat exchanger element under the condition that the heat exchanger element was put in a casing; both ends of the tubes 13 were connected to a pair of metallic headers; water having a temperature of 30° C. was passed in the tubes at a flow rate of 20 l/min and a waste gas from a diesel engine was introduced in gas passages. FIG. 9 represents a result of the experiments. It was revealed that the rate of heat transferred and the overall heat transfer coefficient of the heat exchanger element were remarkably large compared to its compactness.

In the embodiment shown in FIG. 8, the tubes 13 are placed at positions on the lines connecting the tops of the ridge portions in the corrugated plates 21. However, it may be such that the tubes 13 are arranged at positions on the lines penetrating slant surfaces between the ridge portions and bottom portions.

FIGS. 10, 11, 12 and 13 respectively show separate embodiments of the honeycomb body formed by laminating corrugated plates or the corrugated plates and flat plates.

Figure 10:
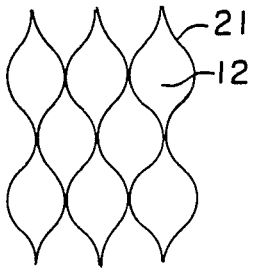
FIGS. 10 to 13 are respectively diagrams showing front views of the separate embodiments of the honeycomb body used in the present invention.

In the embodiment in FIG. 10, only the corrugated plates 21 are laminated in a face-to-face relationship. In this case, the cross-sectional area of each cell 12 can be twice as large as that of the embodiment in FIG. 8 even though the same corrugated plates 21 as in FIG. 8 are used. The embodiment can reduce possibility of increasing of pressure loss at the side of gas which is resulted by accumulation of soot on the inner walls of the gas passages in the case that heat is to be recovered from a waste gas containing undesired material such as soot.

Figure 11:
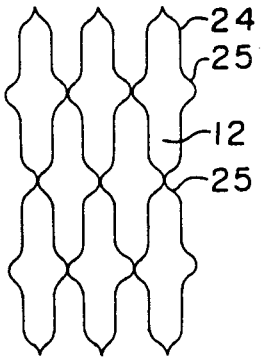

In the embodiment in FIG. 11, flat plates 24 each having small curved portions 25 in a form of projection are laminated with the projections being in contact with each other.

Figure 12:
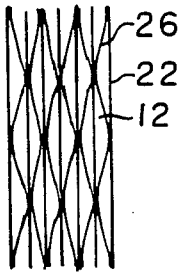

The embodiment shown in FIG. 12 has a combination of corrugated plates 26 and flat plates 22 in which each of the corrugated plates has sharp ridges and bottoms in comparison with those in FIG. 8. In the embodiments in FIGS. 11 and 12, it is possible to reduce pitches between fin plates.

Figure 13:
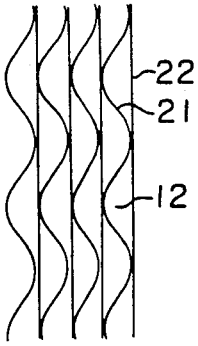

The embodiment of FIG. 13 has a combination of the corrugated plates 21 and flat plates 22 in which the corrugated plates are arranged with the same phase. In this embodiment, a problem of braking down of the heat exchanger element due to thermal stress is reduced because a flat plate 22 is in contact with only one corrugated plate 21 at any contacting area.

In the present invention, it is sufficient that the tubes intersect the gas passages of the honeycomb body at suitable angles. The tubes may not be in parallel with each other. Further, the ends of the tubes may not always project from the outer surfaces of the honeycomb body but may be flush with the outer surfaces of the honeycom body.

The heat exchanger element according to the present invention provides advantages as follows. An economical heat exchanger element having the same function as that having fin tubes can be obtained by inserting tubes in the honeycomb body. Excellent balance of heat and high efficiency of heat exchanging can be attained by enlarging the surface area of the honeycomb body i.e. fins as desired in comparison with the inner surface area of the tubes in the case that the heat exchanger element is used to exchange heat between different kind of fluid such as water and gas which have different heat transfer coefficient. Pressure loss in fluid can be small since fluid such as gas is passed in parallel to the partition walls of the honeycomb body functioning as fins. The heat exchanger element of the present invention is suitably used to pass a hot gas or a corrosive gas which can not be used in the conventional heat exchanger element made of metal. For instance, it is durable to soot firing and acid dew point corrosion caused when it is applied to treatment of a waste gas from a diesel engine. Further, it is possible to prevent leakage of fluid by suitably adjusting the thickness of the tubes, material for the tubes and method of treatment. In addition, thermal stress can be suppressed to a lower level.

What is claimed is:

1. A ceramic heat exchanger element which comprises a ceramic honeycomb body, fluid passages formed in said honeycomb body and at least one ceramic tube extending through and fixed by a binder to said honeycomb body so as to intersect said fluid passages, wherein said honeycomb body and said at least one tube are made of ceramics having a thermal conductivity of 50 Kcal/m/hr/°C. or higher and said binder comprises silicon or a mixture of silicon and silicon carbide as a main component.

2. A ceramic heat exchanger element according to claim 1, wherein said binder is applied to areas where said honeycomb body and said at least one tube are mutually in contact.

3. A ceramic heat exchanger element according to claim 1, wherein said honeycomb body is formed in one piece by extrusion-molding.

4. A ceramic heat exchanger element according to claim 1, wherein said honeycomb body is formed by stacking a plurality of layered bodies and said at least one tube is extended in parallel to the stacking planes of said layered bodies.

5. A ceramic heat exchanger element according to claim 1, wherein said honeycomb body is formed by stacking a plurality of layered bodies and said at least one tube is extended so as to intersect the stacking planes of said layered bodies.

6. A ceramic heat exchanger element according to claim 1, wherein said honeycomb body is formed by laminating corrugated plates or by laminating corrugated plates and flat plates.

7. A ceramic heat exchanger element according to claim 1, wherein a plurality of ceramics tubes are used and said tubes are arranged in parallel to each other.

8. A ceramic heat exchanger element according to claim 1, wherein said at least one tube intersects said fluid passages at right angles.

9. A ceramic heat exchanger element according to claim 1, wherein said at least one tube is arranged not to substantially clog said fluid passages in said honeycomb body.

10. A ceramic heat exchanger element according to claim 1, wherein said ceramics having a thermal conductivity of 50 Kcal/m/hr/°C. or higher contains as a main component at least one selected from a group consisting of silicon carbide, silicon nitride, aluminum nitride, Si-Al-O-N and silicon.

11. A ceramic heat exchanger element according to claim 1, wherein said honeycomb body and said at least one tube are made of substantially same kind of ceramics.

12. A ceramic heat exchanger element according to claim 1, wherein said honeycomb body and/or said at least one tube are made by impregnating silicon in a material which contains as a main component carbon and/or silicon carbide.

13. A ceramic heat exchange element according to claim 1, wherein liquid is passed in said at least one tube and gas is passed in said fluid passages.

* * * * *